US009135870B2

(12) United States Patent
Choi et al.

(10) Patent No.: US 9,135,870 B2
(45) Date of Patent: Sep. 15, 2015

(54) SOURCE DRIVER, CONTROLLER, AND METHOD FOR DRIVING SOURCE DRIVER

(75) Inventors: Jin-cho Choi, Cheongju-si (KR); Jeong-soo Kang, Cheongju-si (KR); Jung-hoon Sul, Cheongju-si (KR); Jung-hyun Kim, Cheongju-si (KR); Kyu-young Chung, Cheongju-si (KR)

(73) Assignee: Magnachip Semiconductor Ltd., Cheongju-si (KR)

( * ) Notice: Subject to any disclaimer, the term of this patent is extended or adjusted under 35 U.S.C. 154(b) by 269 days.

(21) Appl. No.: 13/366,462

(22) Filed: Feb. 6, 2012

(65) Prior Publication Data

US 2012/0200770 A1 Aug. 9, 2012

(30) Foreign Application Priority Data

Feb. 7, 2011 (KR) ..... 10-2011-0010661

(51) Int. Cl.
*G09G 3/36* (2006.01)

(52) U.S. Cl.
CPC ..... *G09G 3/3611* (2013.01); *G09G 2310/027* (2013.01); *G09G 2310/08* (2013.01); *G09G 2320/0693* (2013.01); *G09G 2330/021* (2013.01); *G09G 2330/06* (2013.01)

(58) Field of Classification Search
CPC ..... G09G 3/3611; G09G 2320/0693; G09G 2330/021; G09G 2310/08
USPC ..... 345/98–101
See application file for complete search history.

(56) References Cited

U.S. PATENT DOCUMENTS

| | | | | |
|---|---|---|---|---|
| 7,259,742 | B2 | 8/2007 | Chang et al. | |
| 2003/0001808 | A1* | 1/2003 | Sakuma et al. | 345/87 |
| 2005/0012728 | A1* | 1/2005 | Suzuki | 345/204 |
| 2005/0052397 | A1* | 3/2005 | Chida | 345/99 |
| 2006/0256063 | A1* | 11/2006 | An | 345/98 |
| 2009/0021501 | A1 | 1/2009 | Umezaki | |
| 2011/0181570 | A1* | 7/2011 | Minami | 345/209 |

FOREIGN PATENT DOCUMENTS

| | | | |
|---|---|---|---|
| CN | 1734533 | A | 2/2006 |
| CN | 101167118 | A | 4/2008 |
| KR | 2002-0032113 | A | 5/2002 |
| KR | 2003-0016110 | A | 2/2003 |
| KR | 10-2009-0041181 | A | 4/2009 |
| TW | 200620231 | A | 6/2006 |

OTHER PUBLICATIONS

Chinese Office Action issued on Apr. 29, 2015 in counterpart Chinese Application No. 201210028634.9 (11 pages).

* cited by examiner

*Primary Examiner* — Ryan A Lubit
*Assistant Examiner* — Lisa Landis
(74) *Attorney, Agent, or Firm* — NSIP Law

(57) ABSTRACT

A source driver, a controller, and a method for driving a source drive are provided. The source driver includes a controller configured to receive a start pulse signal, and generate and output one of a new start pulse signal if the start pulse signal is received, and an internal start pulse signal if the start pulse signal is not received, a shift register configured to receive video data, store the video data, and output the video data if the outputted start pulse signal is received by the shift register, a digital-to-analog converter (DAC) configured to convert the video data output from the shift register into an analog voltage signal, and output the analog voltage signal, and an output buffer configured to buffer the analog voltage signal output from the DAC, and output the buffered analog voltage signal.

19 Claims, 5 Drawing Sheets

SOURCE DRIVER, CONTROLLER, AND METHOD FOR DRIVING SOURCE DRIVER

CROSS-REFERENCE TO RELATED APPLICATION

This application claims the benefit under 35 U.S.C. §119 (a) of Korean Patent Application No. 10-2011-0010661 filed on Feb. 7, 2011, in the Korean Intellectual Property Office, the entire disclosure of which is incorporated herein by reference for all purposes.

BACKGROUND

1. Field

The following description relates to a source driver, a controller, and a method for driving a source driver that serve to generate a signal to read video data.

2. Description of the Related Art

A liquid crystal display (LCD) apparatus is an apparatus that converts video data into electric signals and inputs the electric signals. According to an electric driving signal applied to an LCD apparatus, pixels of a liquid crystal layer of the LCD apparatus are controlled to be in a light penetration state or a light interruption state by a transistor included in each of the pixels. Under such control, hundreds of thousands or millions of pixels constitute a single screen of an LCD apparatus.

A driving circuit needed in order to drive the LCD apparatus includes a gate driver to control an on-off state of a switching transistor, and a source driver to select a reference voltage of input video data and supply the reference voltage to a liquid crystal panel.

The source driver generally includes a controller, which receives a clock signal, a polarity conversion signal, and a start pulse signal from external sources. The start pulse signal is a signal to start to output the video data input to a shift register.

If a predetermined time elapses after the start pulse signal has been input, the controller of the related-art source driver generates a new start pulse signal and transmits the new start pulse signal to a source driver of a neighboring channel.

The LCD apparatus includes a plurality of source drivers. One source driver may generate a new start pulse signal and transmit the new start pulse signal to a source driver of a neighboring channel if a predetermined time elapses after the start pulse signal has been input.

For example, a source driver of a second channel outputs video data if it receives a start pulse signal generated by a source driver of a first channel. If a predetermined time elapses, the source driver of the second channel generates a new start pulse signal and transmits the new start pulse signal to a source driver of a third channel.

Through the above-described process, the plurality of source drivers included in the LCD apparatus outputs the video data in sequence.

However, the related-art LCD apparatus includes a configuration to input and output the start pulse signals among the source drivers. Accordingly, each of the start pulse signals is generated periodically and transmitted to the outside of the LCD apparatus.

Each of the start pulse signals may be generated with a predetermined period. Such signals generated with a period may become noise, being included in a frequency band of a baseband of 900 MHz of a wireless wide area network (WWAN). Therefore, in an apparatus including the WWAN and the LCD apparatus simultaneously, such as a notebook computer, wireless communication may be influenced by the start pulse signal.

Also, the start pulse signal may be generated as many as N−1 for each line of the LCD apparatus and as many as (N−1)×the number of lines for each frame. Therefore, power consumption increases and may cause aging and deterioration of the LCD apparatus.

SUMMARY

In one general aspect, there is provided a source driver, including a controller configured to receive a start pulse signal, and generate and output one of a new start pulse signal if the start pulse signal is received, and an internal start pulse signal if the start pulse signal is not received, a shift register configured to receive video data, store the video data, and output the video data if the outputted start pulse signal is received by the shift register, a digital-to-analog converter (DAC) configured to convert the video data output from the shift register into an analog voltage signal, and output the analog voltage signal, and an output buffer configured to buffer the analog voltage signal output from the DAC, and output the buffered analog voltage signal.

A general aspect of the source driver may further provide that the controller includes a start pulse signal generator configured to generate the new start pulse signal, and transmit the new start pulse signal to another channel source driver connected to the source driver, a channel number counter configured to count a channel number of the source driver, and determine a time at which the shift register outputs the video data, and an internal start pulse signal generator configured to receive the time at which the video data is output from the channel number counter, and generate the internal start pulse signal and outputs the internal start pulse signal.

A general aspect of the source driver may further provide that, in a frame synchronization mode in which a frame is synchronized after one frame has been displayed, the channel number counter re-counts the channel number of the source driver based on a start pulse signal received from another channel source driver connected to the source driver.

A general aspect of the source driver may further provide that, in a display mode in which the video data is read, the start pulse signal generator does not output the start pulse signal.

A general aspect of the source driver may further provide that, in a calibration mode in which the channel number of the source driver is counted, the channel number counter counts the channel number of the source driver based on a start pulse signal output from another channel source driver connected to the source driver.

A general aspect of the source driver may further provide that, in a calibration mode, the channel number counter counts the channel number of the source driver based on a start pulse signal output from another channel source driver connected to the source driver, in a display mode, the start pulse signal generator does not output the start pulse signal and outputs the video data based on the internal start pulse signal, and, in a frame synchronization mode, the channel number counter re-counts the channel number of the source driver based on a start pulse signal received from another channel source driver connected to the source driver.

A general aspect of the source driver may further provide an internal counter having a predetermined period, the internal counter being configured to count a number of last line signals output from the start pulse signal generator. A general aspect of the source driver may further provide that the channel number counter counts the channel number of the source driver by comparing the number of last line signals counted by the internal counter and the start pulse signal received from another channel source driver.

A general aspect of the source driver may further provide a shift direction determiner configured to select another channel source driver to transmit the new start pulse signal based on a shift direction signal input from an external source.

In another general aspect, there is provided a controller included in a source driver, the controller including a channel number counter configured to count a channel number of the source driver, and an internal start pulse signal generator configured to generate and output an internal start pulse signal to output video data to be input to the source driver based on the channel number of the source driver.

In yet another general aspect, there is provided a method for driving a source driver, the method including counting a channel number of the source driver, and generating an internal start pulse signal to output video data to be input to the source driver based on the channel number of the source driver, and driving the source driver using the internal start pulse signal.

A general aspect of the method may further provide outputting the video data if the internal start pulse signal is generated, converting the video data into an analog voltage signal, outputting the converted analog voltage signal, buffering the outputted analog voltage signal, and outputting the buffered analog voltage signal.

A general aspect of the method may further provide receiving a start pulse signal from another channel source driver connected to the source driver, and counting the channel number of the source driver based on the start pulse signal.

A general aspect of the method may further provide synchronizing a frame after the driving of the source driver, the synchronizing of the frame including recounting the channel number of the source driver based on a start pulse signal output from another channel source driver connected to the source driver.

A general aspect of the method may further provide outputting a new start pulse signal to another channel source driver connected to the source driver, and counting the channel number of the source driver by comparing a number of last line signals counted by an internal counter of the source driver and having a predetermined period, and the start pulse signal received from another channel source driver.

A general aspect of the method may further provide selecting another channel source driver to transmit a start pulse signal based on a shift direction signal input from an external source.

A general aspect of the method may further provide that a start pulse signal is not received from another channel source driver connected to the source driver.

Other features and aspects may be apparent from the following detailed description, the drawings, and the claims.

Figure 1:
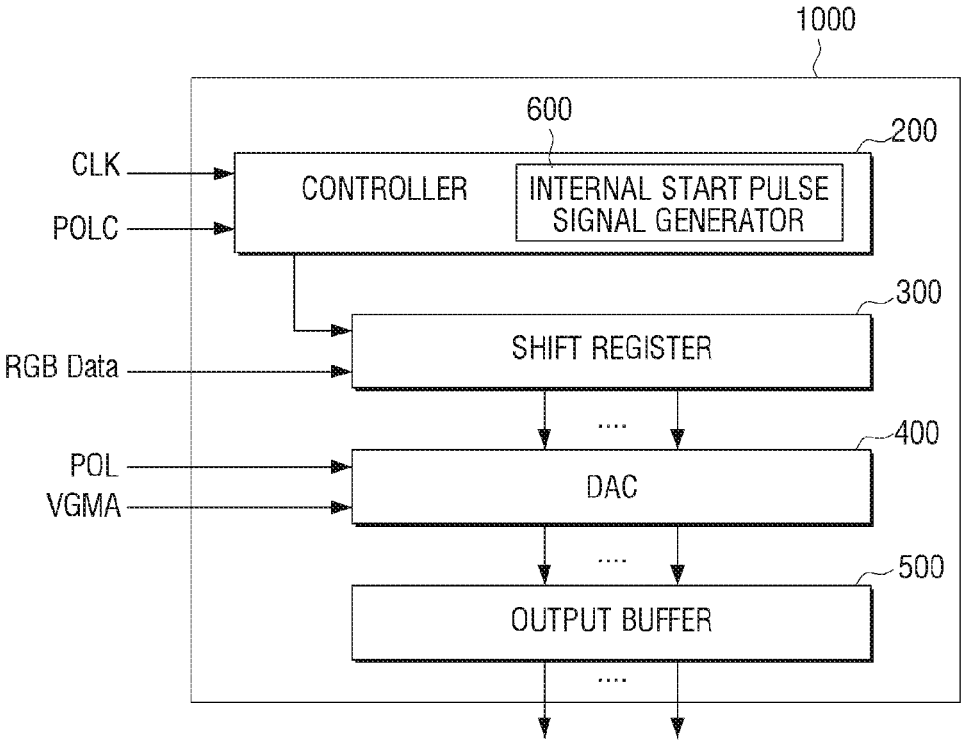
FIG. 1 is a block diagram illustrating an example of a source driver according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

FIG. 1 is a block diagram illustrating an example of a source driver 1000 according to an embodiment. As is shown in FIG. 1, the source driver 1000 includes a controller 200, a shift register 300, a digital-to-analog converter (DAC) 400, and an output buffer 500.

The controller 200 receives a clock signal CLK and a polarity conversion signal POLC. The controller 200 may receive the clock signal CLK and the polarity conversion signal POLC from a timing circuit (not shown) which is disposed outside the source driver 1000. The clock signal CLK and the polarity conversion signal POLC determine a timing of an operation of an LCD apparatus.

The clock signal CLK is a signal for horizontal synchronization, and indicates a start of driving of each line. That is, if the clock signal CLK is input, a plurality of source drivers starts to be driven in sequence. When a work performed by the last source driver among the plurality of source drivers finishes, a new clock signal may be input again, and, accordingly, the plurality of source drivers may be driven again in sequence. Further, the polarity conversion signal POLC is a signal to determine a P polarity and an N polarity of a liquid crystal element.

However, the controller 200 shown in FIG. 1 may not receive a start pulse signal such as is received by a related-art controller. Instead, the controller 200 may include an internal start pulse signal generator 600 that generated an internal start pulse signal to drive the source driver 1000, including the controller 200, at an appropriate time. Accordingly, even if the source driver 1000, including the controller 200, does not receive a start pulse signal from a source driver of another neighboring channel in a display mode, due to generation of an internal start pulse signal by the internal start pulse signal generator 600 of the controller 200, the source driver 1000 can output video data RGB DATA at an appropriate time.

The start pulse signal received or generated by the controller 200 is transmitted to the shift register 300. The shift register 300 may receive video data RGB DATA from an external timing circuit (not shown). The shift register 300 temporarily stores the video data RGB DATA. For example, the shift register 300 may sample the video data RGB DATA and store it in the form of a latch memory.

The shift register 300 transmits the stored, and possibly sampled, video data RGB DATA to the DAC 400 upon receiving the start pulse signal from the controller 200. That is, the shift register 300 may output the video data RGB DATA from a time when the start pulse signal is received.

The DAC 400 converts the video data RGB DATA received from the shift register 300 into an analog voltage signal. The DAC 400 may receive a polarity control signal POL and a reference voltage control signal VGMA. The polarity control signal POL is a signal to control a polarity of a liquid crystal panel. The reference voltage control signal VGMA is a signal to determine a value of the analog voltage signal output from the DAC 400. That is, the DAC 400 may determine the value of the analog voltage signal to be output to the liquid crystal panel based on a reference voltage input from an external reference voltage generation circuit (not shown).

The output buffer 500 buffers the analog voltage signal output from the DAC 400 and outputs the buffered analog voltage signal. The output buffer 500 may be realized in the form of an operational amplifier, i.e. OP-AMP.

As described above, the source driver 1000 may not receive the start pulse signal from the source driver of another channel in the display mode. In this case, the internal start pulse signal generator 600 included in the controller 200 of the source driver 1000 generates an internal start pulse signal so that the video data RGB DATA can be outputted based on a driving time of the source driver 1000. The controller 200, in which the internal start pulse signal is generated by the internal start pulse signal generator 600, outputs the generated internal start pulse signal to the shift register 300. Accordingly, the plurality of source drivers can be driven without inputting and outputting the start pulse signal among the plurality of source drivers.

Figure 2:
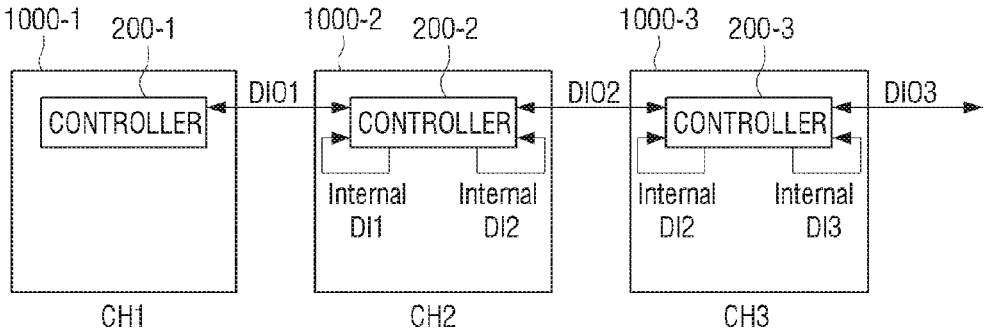
FIG. 2 is a concept view illustrating an example of input and output of start pulse signals among source drivers according to an embodiment.

FIG. 2 is a concept view illustrating an example of input and output of start pulse signals among source drivers according to an embodiment. As is shown in FIG. 2, an LCD apparatus may include a plurality of source drivers 1000-1, 1000-2, and 1000-3 of a plurality of channels. FIG. 2 illustrates signal input and output in a display mode of the plurality of source drivers 1000-1, 1000-2, and 1000-3 and in a calibration mode in which a channel number of each source driver 1000-1, 1000-2, and 1000-3 is determined.

The source drivers 1000-1, 1000-2, and 1000-3 corresponding to the plurality of channels may determine their respective channel numbers in the calibration mode. In the calibration mode, the source drivers 1000-1, 1000-2, and 1000-3 may input and output start pulse signals DIO1, DIO2, and DIO3 to one another. Further, one of the source drivers 1000-1, 1000-2, and 1000-3 may determine its own channel number based on the start pulse signal received from another channel source driver connected thereto.

However, in the display mode in which each of the source drivers 1000-1, 1000-2, and 1000-3 applies a signal to the liquid crystal panel, the start pulse signals DIO1, DIO2, and DIO3 inputted and outputted among the source drivers 1000-1, 1000-2, and 1000-3 are not inputted and outputted any longer. In the display mode, the source drivers 1000-1, 1000-2, and 1000-3 begin outputting video data RGB DATA based on internal start pulse signals Internal DI1, Internal DI2, and Internal DI3 generated by controllers 200-1, 200-2, and 200-3 included in the source drivers 1000-1, 1000-2, and 1000-3. Accordingly, since the start pulse signals DIO1, DIO2, and DIO3 are not inputted and outputted among the source drivers 1000-1, 1000-2, and 1000-3 in the display mode, noise caused by the start pulse signal having a predetermined period can be attenuated. In addition, power consumption caused by the start pulse signal in the display mode can be reduced.

Figure 3:
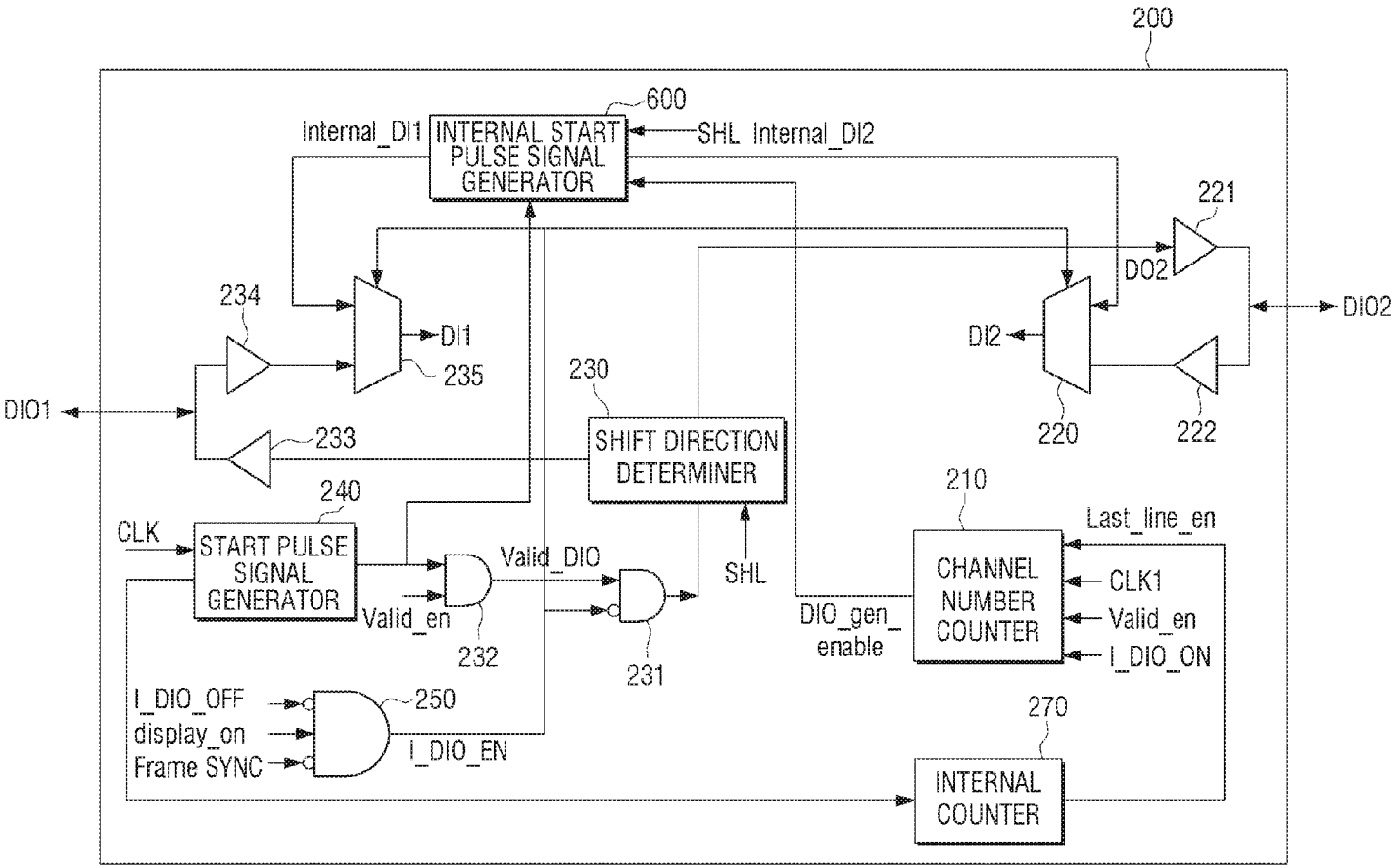
FIG. 3 is a block diagram illustrating an example of a controller according to an embodiment.

FIG. 3 is a block diagram illustrating an example of a controller 200 included in a source driver 1000 according to an embodiment. As is shown in FIG. 3, the controller 200 includes an internal start pulse signal generator 600 to generate an internal start pulse signal, input and output interfaces 233 and 234 of a first start pulse signal DIO1, input and output interfaces 221 and 222 of a second start pulse signal DIO2, a shift direction determiner 230, a channel number counter 210, a start pulse signal generator 240, and a plurality of AND elements 231, 232, and 250. Hereinafter, an operation of each element in a calibration mode, a display mode, and a synchronization mode will be explained.

1. Calibration Mode

If a clock signal is input, the start pulse signal generator 240 may generate a last line signal Last_line_en of a pulse form and a start pulse signal according to a predetermined period.

The last line signal Last_line_en is a pulse wave having a period set at a time when the source driver 1000 is manufactured. The last line signal Last_line_en has a pattern of generating a pulse for a video data output period allocated to a source driver of each channel. For example, if the number of source drivers driven within a period of the clock signal is 'n', the last line signal Last_line_en may be generated 'n' times within the period of the clock signal. A process of generating the last line signal Last_line_en will be explained in detail below.

The start pulse signal generator 240 may generate a start pulse signal to be input to another channel source driver connected to the source driver 1000. The start pulse signal may be generated in a related-art method for generating a new start pulse signal in response to a start pulse signal input from another channel source driver.

The start pulse signal generator 240 is connected to the AND element 232 and the internal start pulse signal generator 600. If the source driver 1000 is in a display mode, the internal start pulse signal generator 600 may generate an internal start pulse signal using the start pulse signal generated by the start pulse signal generator 240.

An input unit of the AND element 232 connected to the start pulse signal generator 240 receives the start pulse signal generated by the start pulse signal generator 240. Another input unit of the AND element 232 receives a source driver driving signal Valid_en. That is, the AND element 232 outputs a start pulse signal driving signal Valid_DIO if both a value of the start pulse signal generated by the start pulse signal generator 240 and a value of the source driver driving signal Valid_en are "1".

An output stage of the AND element 232 is connected to an input stage of another AND element 231. The input stage of the AND element 231 is connected to an output stage of the AND element 250 having three input stages. The AND element 250 having the three input stages receives an internal start pulse off signal I_DIO_OFF, a display start signal display_on, and a frame synchronization signal Frame SYNC. The internal start pulse off signal I_DIO_OFF and the frame synchronization signal Frame SYNC may be reversed before they are input to the AND element 250. The output stage of the AND element 250 may output an internal start pulse signal driving signal I_DIO_EN.

Herein, an internal start pulse driving signal I_DIO_EN may be input to multiplexers 220, 235 to determine use of either a start pulse Internal_DI1 signal generated in the internal source driver 1000 or a start pulse signal from output interfaces 222, 234, respectively, that has been input from another external source driver. The internal start pulse driving signal I_DIO_EN has a value of 1 or 0 according to the internal start pulse off signal I_DIO_OFF, the display start signal display_on, and the frame synchronization signal frame SYNC. At this time, the internal start pulse off signal I_DIO_OFF is a parameter signal that determines whether a mode that uses an internal DIO on or off. During the period of the frame synchronization signal Frame SYNC, the internal start pulse driving signal I_DIO_EN has a value of 0 because a calibration should be processed by using external start signals. The display_on signal indicates a display period.

The two input stages of the AND element 231 receives the start pulse signal driving signal Valid_DIO and the reversed internal start pulse signal driving signal I_DIO_EN. That is, if a value of the start pulse signal driving signal Valid_DIO input to the AND element 231 is "1" and a value of the internal start pulse signal driving signal I_DIO_EN is "0", a value of an output signal of the AND element 231 will be "1". For example, since a value of the internal start pulse off signal I_DIO_OFF is "1" and the internal start pulse off signal I_DIO_OFF is reversed before it is input to the AND element 250, if the source driver 1000 is in the calibration mode, an output value of the AND element 250 is "0".

As mentioned above, one of the two input stages of the AND element 231 receives the value "1", which is the reverse of the output value "0" of the AND element 250, and the other input stage receives the value "1" of the start pulse signal driving signal Valid_DIO. Therefore, the output stage of the AND element 231 outputs a signal of "1". Since the value output from the AND element 231 is "1", the start pulse signal generated by the start pulse signal generator 240 may be output to another channel source driver connected to the source driver 1000 in the calibration mode.

The output stage of the AND element 231 is connected to the shift direction determiner 230. The shift direction determiner 230 may determine a shift direction based on an input shift direction signal SHL value. For example, if the value of the shift direction signal SHL is "1", the shift direction is determined to be a rightward direction from the left. If the value of the shift direction signal SHL is "0", the shift direction is determined to be a leftward direction from the right.

The shift direction determiner 230 is connected to the input and output interfaces 233 and 234 of the first start pulse signal DIO1 and the input and output interfaces 221 and 222 of the second start pulse signal DIO2. If the value of the shift direction signal SHL is "1", the start pulse signal generated by the AND element 231 may be output to the input and output interfaces 221 and 222 of the second start pulse signal DIO2.

The input and output interfaces 233 and 234 of the first start pulse signal DIO1 and the input and output interfaces 221 and 222 of the second start pulse signal DIO2 may receive the start pulse signals DIO1 and DIO2 from other channel source drivers connected to the source driver 1000. The start pulse signals DIO1 and DIO2 input from other channel source drivers may be transmitted to the multiplexers 220 and 235 and then transmitted to a shift register 300.

If the LCD apparatus is in the calibration mode, the channel number counter 210 of the source driver 1000 may determine a channel number of the source driver 1000. The channel number counter 210 receives the last line signal Last_line_en, the clock signal CLK1, the driving signal Valid_en, and the internal pulse on signal I_DIO_ON, and may count the channel number of the source driver 1000 based on these signals.

As described above, the last line signal Last_line_en is a signal that is generated by the start pulse signal generator 240 with a predetermined period. The last line signal Last_line_en may be transmitted to an internal counter 270 by the start pulse signal generator 240 and to the channel number counter 210 by the internal counter 270. The internal counter 270 generates an internal counting pulse, thereby counting the number of transmitted last line signals Last_line_en. In addition, the internal counter 270 may transmit the number of last line signals Last_line_en to the channel number counter 210.

The channel number counter 210 may count the channel number of the source driver 1000 based on the number of last line signals Last_line_en transmitted in a section in which the value of the driving signal Valid_en is "1". The driving signal Valid_en is a signal to control to drive the source driver 1000 and may be generated by the start pulse signal generated by another channel source driver. For example, it is assumed that the value of the shift direction signal SHL is "1" and the source driver 1000 has channel number "3". In the calibration mode, the controller of the source driver 1000 of channel number 3 may receive a start pulse signal from a source driver of channel number 2. The start pulse signal generator included in the controller of the source driver of channel number 3 generates a last line signal for a period during which the source driver of each channel is driven.

The channel number counter 210 may receive a driving signal Valid_en having a value of "1" if the start pulse signal is input from the source driver of channel number 2. At this time, the channel number counter 210 receives two last line signals Last_line_en. Accordingly, the channel number counter 210 may count the channel number of the source driver 1000 including the channel number counter 210 as "3".

2. Display Mode

If the channel number counter 210 receives the internal start pulse on signal I_DIO_ON, the channel number counter 210 may transmit the counted channel number to the internal start pulse signal generator 600.

The internal start pulse signal generator 600 generates the internal start pulse signals Internal DI1 and Internal DI2 using the signal received from the start pulse signal generator 240 and outputs the internal start pulse signals Internal DI1 and Internal DI2, so that a liquid crystal panel corresponding to a channel number can be displayed based on the channel number of the source driver 1000 input from the channel number counter 210.

The internal start pulse signal generator 600 may receive the shift direction signal SHL. The internal start pulse signal generator 600 may output the internal start pulse signals to the multiplexer 235 if the value of the shift direction signal SHL is "1" and to the multiplexer 220 if the value of the shift direction signal SHL is "0".

Since a value of the internal start pulse off signal I_DIO_OFF is "0", a value of the display start signal display_on is "1", and a value of the frame synchronization signal is "0" in the display mode, the output value of the AND element 250 is "1", and, accordingly, the input value of the AND element 231 is "0", which is the reverse of "1". Therefore, the output value of the AND element 231 is "0". Accordingly, in the display mode, the start pulse signal generated by the start pulse signal generator 240 is not transmitted to the outside of the controller 200.

3. Synchronization Mode

A new frame is synchronized in the synchronization mode after one horizontal frame has been displayed. In the synchronization mode, the start pulse signal generated by the start pulse signal generator 240 may be output to the input and output interfaces 233 and 234 of the first start pulse signal DIO1 and the input and output interfaces 221 and 222 of the second start pulse signal DIO2.

The channel number counter 210 may re-count the channel number of the source driver 1000 in the synchronization mode. The channel number of the source driver is periodically counted so that a variation in the counting value caused by an external influence can be minimized.

Figure 4:
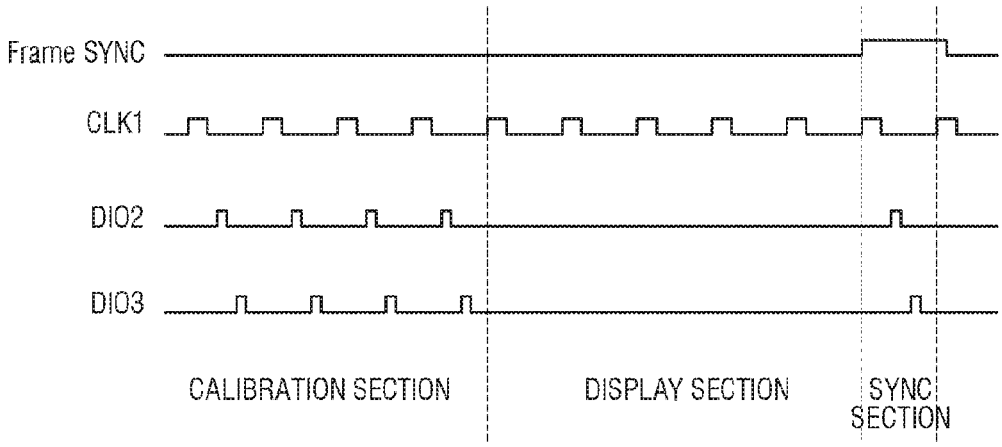
FIG. 4 is a timing chart illustrating examples of signals input and output to and from a source driver according to an embodiment.

FIG. 4 is a timing chart illustrating examples of signals input and output to and from a source driver according to an embodiment to explain timing of the above-described various signals. As is shown in FIG. 4, the operation of the source driver 1000 may be divided into three sections—a calibration section, a display section, and a synchronization section. In the calibration section, the start pulse signals DIO2 and DIO3 are periodically generated, and inputted and outputted. However, in the display section, the start pulse signals DIO2 and DIO3 are not generated. As described above, the start pulse signals may not be inputted and outputted among the source drivers in the display section, thereby minimizing an influence on a WWAN located nearby the LCD apparatus. In addition, in the synchronization section, the start pulse signals DIO2 and DIO3 are once generated, and inputted and outputted. As described above, the channel number of the source driver 1000 is periodically counted so that an external influence can be minimized.

Figure 5:
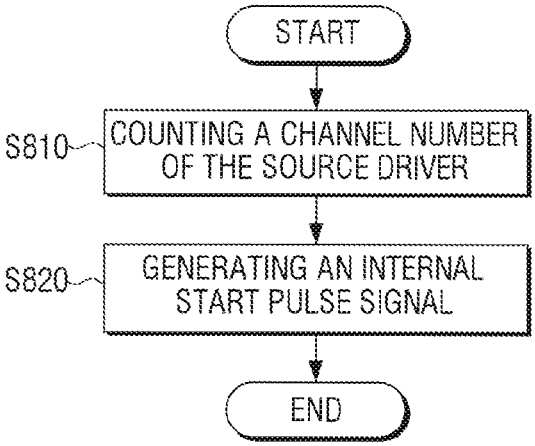
FIG. 5 is a flowchart illustrating an example of a method for driving a source driver according to an embodiment.

FIG. 5 is a flowchart illustrating an example of a method for driving a source driver according to an embodiment. As is shown in FIG. 5, the source driver counts a channel number of the source driver (S810). This operation corresponds to the above-described calibration mode. The calibration operation of counting the channel number of the source driver has been described above in detail and thus a detailed description is omitted here.

The source driver generates an internal start pulse signal to output video data based on the counted channel number of the source driver (S820) and is driven, thereby displaying an image on an LCD apparatus (S830).

If the internal start pulse signal is generated, the displaying operation may include outputting the video data, converting the video data into an analog voltage signal, outputting the analog voltage signal, buffering the outputted analog voltage signal, and outputting the buffered analog voltage signal.

The calibration operation may include receiving a start pulse signal from another channel source driver connected to the source driver, and counting the channel number of the source driver based on the start pulse signal.

The method for driving the source driver may further include synchronizing a frame after the displaying operation. The frame synchronization operation may re-count the channel number of the source driver based on the start pulse signal output from another channel source driver connected to the source driver.

The calibration operation of the method for driving the source driver may further include outputting a new start pulse signal to another channel source driver connected to the source driver, and counting the channel number of the source driver by comparing the number of last line signals counted by an internal counter of the source driver and having a predetermined period and the start pulse signal received from another channel source driver.

The calibration operation may further include a shift direction determination operation to select another channel source driver to transmit the start pulse signal based on a shift direction signal input from an external source.

The displaying operation may not receive the start pulse signal from another channel source driver connected to the source driver.

For example, the displaying operation does not receive the start pulse signal from another channel source driver connected to the source driver the same way as described above.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A source driver, comprising:

a controller configured to:

receive a start pulse signal, and generate and output an internal start pulse signal in response to the start pulse signal not being received;

a shift register configured to:

receive video data, store the video data, and output the video data in response to the outputted start pulse signal being received by the shift register;

a digital-to-analog converter (DAC) configured to:

convert the video data output from the shift register into an analog voltage signal, and output the analog voltage signal; and an output buffer configured to:

buffer the analog voltage signal output from the DAC, and output the buffered analog voltage signal.

2. The source driver as claimed in claim 1, wherein the controller comprises:

a start pulse signal generator configured to:

generate a new start pulse signal, and transmit the new start pulse signal to a new channel source driver connected to the source driver;

a channel number counter configured to:

count a channel number of the source driver, and determine a time at which the shift register outputs the video data; and an internal start pulse signal generator configured to:

receive the time at which the video data is output from the channel number counter, and generate the internal start pulse signal and output the internal start pulse signal.

3. The source driver as claimed in claim 2, wherein, in a frame synchronization mode in which a frame is synchronized after one frame has been displayed, the channel number counter is configured to re-count the channel number of the source driver based on the start pulse signal being received from another channel source driver connected to the source driver.

4. The source driver as claimed in claim 2, wherein, in a display mode in which the video data is read, the start pulse signal generator does not output the start pulse signal.

5. The source driver as claimed in claim 2, wherein, in a calibration mode in which the channel number of the source driver is counted, the channel number counter is configured to count the channel number of the source driver based on the start pulse signal being output from another channel source driver connected to the source driver.

6. The source driver as claimed in claim 2, wherein:

in a calibration mode, the channel number counter is configured to count the channel number of the source driver based on the start pulse signal being output from another channel source driver connected to the source driver;

in a display mode, the start pulse signal generator does not output the start pulse signal and is configured to output the video data based on the internal start pulse signal; and in a frame synchronization mode, the channel number counter is configured to re-count the channel number of the source driver based on the start pulse signal received from another channel source driver connected to the source driver.

7. The source driver as claimed in 5, further comprising:

an internal counter having a predetermined period, the internal counter being configured to count a number of last line signals output from the start pulse signal generator, wherein the channel number counter is configured to count the channel number of the source driver by comparing the number of last line signals counted by the internal counter and the start pulse signal received from another channel source driver.

8. The source driver as claimed in claim 1, further comprising:

a shift direction determiner configured to select a new channel source driver to transmit a new start pulse signal based on a shift direction signal input from an external source.

9. A controller included in a source driver, the controller comprising:

a channel number counter configured to count a channel number of the source driver by comparing a last line signal generated by the controller, and a start pulse signal received from another channel source driver connected to the source driver; and an internal start pulse signal generator configured to generate and output an internal start pulse signal to output video data to the source driver based on the channel number of the source driver when the channel number counter indicates the start pulse signal not being received.

10. A method of driving a source driver, the method comprising:

counting a channel number of the source driver by comparing a start pulse signal received from another channel source driver connected to the source driver, and a number of last line signals;

generating an internal start pulse signal to output video data to the source driver based on the channel number of the source driver; and driving the source driver using the internal start pulse signal when the start pulse signal not being received from said another channel source driver.

11. The method as claimed in claim 10, further comprising:

outputting the video data in response to the internal start pulse signal being generated;

converting the video data into an analog voltage signal;

outputting the converted analog voltage signal;

buffering the outputted analog voltage signal; and outputting the buffered analog voltage signal.

12. The method as claimed in claim 10, further comprising:

receiving the start pulse signal from the other channel source driver connected to the source driver.

13. The method as claimed in claim 10, further comprising:

synchronizing a frame after the driving of the source driver, the synchronizing of the frame comprising recounting the channel number of the source driver based on the start pulse signal output from the other channel source driver connected to the source driver.

14. The method as claimed in claim 12, further comprising:

outputting a new start pulse signal to a new channel source driver connected to the source driver, wherein the number of last line signals are counted by an internal counter of the source driver, and the internal counter of the source driver has a predetermined period.

15. The method as claimed in claim 10, further comprising:

selecting a new channel source driver to transmit a new start pulse signal based on a shift direction signal input from an external source.

16. The source driver as claimed in claim 1, wherein the controller is configured to receive the start pulse signal from another channel source driver connected to the source driver.

17. The source driver as claimed in claim 16, wherein a first multiplexer and a second multiplexer are configured to receive the start pulse signal.

18. The source driver as claimed in claim 12, wherein the receiving of the start pulse signal from the other channel source driver connected to the source driver comprises receiving a driving signal having a logic high value.

19. The source driver as claimed in claim 12, wherein the receiving of the start pulse signal from the other channel source driver connected to the source driver comprises receiving a driving signal having a logic high value simultaneously with a number of last line signals.

* * * * *